US010850157B2

(12) United States Patent
Van Straaten et al.

(10) Patent No.: US 10,850,157 B2
(45) Date of Patent: Dec. 1, 2020

(54) EXERCISE MACHINE

(71) Applicant: Willem Johannes Van Straaten, Sandton (ZA)

(72) Inventors: Willem Johannes Van Straaten, Sandton (ZA); Andrea Van Straaten, Sandton (ZA)

( * ) Notice: Subject to any disclaimer, the term of this patent is extended or adjusted under 35 U.S.C. 154(b) by 0 days.

(21) Appl. No.: 16/339,645

(22) PCT Filed: Jun. 15, 2017

(86) PCT No.: PCT/ZA2017/050035
§ 371 (c)(1),
(2) Date: Apr. 4, 2019

(87) PCT Pub. No.: WO2018/094424
PCT Pub. Date: May 24, 2018

(65) Prior Publication Data

US 2020/0038705 A1 Feb. 6, 2020

(30) Foreign Application Priority Data

Nov. 21, 2016 (ZA) ..... 2016/08030

(51) Int. Cl.
*A63B 22/00* (2006.01)
*A63B 21/00* (2006.01)
(Continued)

(52) U.S. Cl.
CPC ..... *A63B 22/0015* (2013.01); *A63B 21/154* (2013.01); *A63B 21/225* (2013.01);
(Continued)

(58) Field of Classification Search
CPC ..... A63B 21/00058; A63B 21/00069; A63B 21/00072; A63B 21/00076;
(Continued)

(56) References Cited

U.S. PATENT DOCUMENTS 3,888,136 A 6/1975 Lapeyre
5,261,294 A * 11/1993 Ticer ..... B62M 3/02 280/260

(Continued)

FOREIGN PATENT DOCUMENTS

EP 1920748 A1 5/2008
WO WO 2013/067999 5/2013
WO WO 2015/139006 9/2015

OTHER PUBLICATIONS

ISR in corresponding PCT application PCT/ZA2017/050035 = WO2018/094424.

(Continued)

*Primary Examiner* — Gary D Urbiel Goldner
(74) *Attorney, Agent, or Firm* — Bereskin & Parr LLP/S.E.N.C.R.L.,S.R.L.

(57) ABSTRACT

An exercise machine which provides a continuously variable exercise path for a user, based on the use of a first crank which rotates about a primary axis, and a second crank which is user-rotated about a second axis on the first crank and which is linked to a stationary cog so that the first and second cranks counter-rotate.

19 Claims, 12 Drawing Sheets

(51) Int. Cl.
*A63B 21/22* (2006.01)
*A63B 22/06* (2006.01)

(52) U.S. Cl.
CPC ..... *A63B 22/0605* (2013.01); *A63B 22/0664* (2013.01); *A63B 2022/0617* (2013.01)

(58) Field of Classification Search
CPC ... A63B 21/0608; A63B 21/15; A63B 21/151; A63B 21/154; A63B 21/155; A63B 21/156; A63B 21/159; A63B 21/22; A63B 21/225; A63B 21/4027; A63B 21/4033; A63B 21/4034; A63B 21/4041; A63B 21/4045; A63B 21/4047; A63B 21/4049; A63B 22/0002; A63B 22/0005; A63B 22/001; A63B 22/0015; A63B 22/0017; A63B 22/0046; A63B 22/06; A63B 22/0605; A63B 22/0664; A63B 22/0694; A63B 2022/0611; A63B 2022/0617; A63B 2022/0623; A63B 2022/0629; A63B 2022/0635; A63B 2022/0647; A63B 2022/067; A63B 2022/0676; A63B 2022/0688; A63B 23/035; A63B 23/03516; A63B 23/0355; A63B 23/03575; A63B 23/04; A63B 23/0405; A63B 23/0423; A63B 23/0476; A63B 23/0482; A63B 23/0494; A63B 69/16; A63B 2225/09; A63B 2225/093
See application file for complete search history.

(56) References Cited

U.S. PATENT DOCUMENTS 5,735,774 A * 4/1998 Maresh ..... A63B 22/0605 482/52
6,206,804 B1 * 3/2001 Maresh ..... A63B 21/068 482/51
6,334,836 B1 1/2002 Segasby
6,685,598 B1 2/2004 Rufino
7,163,491 B2 1/2007 Rufino
8,690,737 B2 4/2014 Van Straaten
9,302,148 B1 4/2016 Vujicic
2002/0094914 A1 * 7/2002 Maresh ..... A63B 21/068 482/51
2006/0183605 A1 * 8/2006 Dyer ..... A63B 22/001 482/52
2007/0099762 A1 * 5/2007 Stevens ..... A63B 22/0664 482/52
2007/0179026 A1 8/2007 Wu
2007/0298935 A1 * 12/2007 Badarneh ..... A63B 22/0664 482/52
2011/0263388 A1 * 10/2011 Tamari ..... A63B 22/0015 482/57
2011/0281694 A1 * 11/2011 Vujicic ..... A63B 22/0605 482/63
2014/0243159 A1 * 8/2014 Oblak ..... A63B 22/0664 482/57
2015/0238805 A1 8/2015 Yang

OTHER PUBLICATIONS

WO in corresponding PCT application.
Demand in corresponding PCT application.
IPRP in corresponding PCT application.
Letter of Nov. 14, 2018 from Rademeyer in corresponding PCT application.
Letter of Jan. 18, 2019 from Rademeyr in corresponding PCT application.
Letter of Feb. 20, 2019 from EPO in corresponding PCT application.

* cited by examiner

EXERCISE MACHINE

CROSS-REFERENCE TO RELATED APPLICATIONS

This application is a National Stage entry of PCT/ZA2017/050035 filed Jun. 15, 2017 which claims priority to South African Application Number 2016/08030, filed Nov. 21, 2016, which are incorporated herein in their entireties.

BACKGROUND OF THE INVENTION

This invention relates to an exercise machine which can be used in different ways but which is particularly suitable for exercising the legs, core and upper body of a user.

In one respect a group of exercise machines can be placed into the following categories: elliptical trainers (wherein a user's feet follow elliptical paths); cycles (a user's feet follow circular paths); steppers (a user's feet engage in vertical up-down movement); stair climbers (a user's feet follow inclined paths); and skiing machines (wherein the paths of feet movement are substantially horizontal).

In general, a machine in any of the aforementioned categories can be regarded as a single-mode exercise machine in that it offers only one type of movement path during exercise. A shortcoming of these single-mode devices is that they train the same muscle or muscles along a single, fixed path. Physiologically, this results in training a limited group of muscles. Psychologically, performing the same movement repeatedly leads to exercise boredom, resulting in dropping out of an exercise routine. Also, a stroke distance of a single-mode device is fixed and relatively short.

There is much evidence suggesting that doing the same type of exercise repetitively leads to boredom and staleness and, in extreme instances, can result in an overuse injury, a loss in training time and, in the case of an athlete, an inability to compete.

U.S. Pat. No. 8,690,737 describes an elliptical exerciser which allows a user to change the movement path. To do so the user must stop exercising in order to reconfigure some part of the exercise machine. Thus, there is an abrupt change from one mode to another mode of exercising as well as a loss of exercise time.

Elliptical path exercise machines are popular. This type of machine provides a foot motion which traces a path which approximates an ellipse. A drawback of this type of machine, however, is its relatively large footprint.

U.S. Pat. Nos. 6,685,598 and 7,163,491 each describe a machine which is of a compact configuration but which suffers the limitation of a repetitive, fixed elliptical path of movement. Other disclosures of interest are U.S. Pat. Nos. 9,302,148 and 6,685,598 which describe epicyclical gear arrangements for use in an exercise machine. However, due to the intermeshing of its gears, the machine is noisy, does not necessarily provide a smooth motion and, most likely, will suffer from "backlash" due to the tolerance which is required between gears.

An object of the present invention is to provide an exercise machine which is of a compact configuration and which allows a force application component such as a foot pedal to follow a continuously variable path during a number of operational cycles i.e. a path which is not repeated with each cycle of operation. The variability which is thereby provided enhances an exercise regime in which different muscles are exercised to different degrees, with each cycle of operation.

A further object of the present invention to provide an exercise machine that in one embodiment trains the muscles over a longer range of motion and wherein exercise boredom is combatted by automatically and continuously changing an exercise movement path.

SUMMARY OF THE INVENTION

The invention provides, in the first instance, an exercise machine which includes a support structure, a force transfer arrangement mounted to the support structure for rotational movement about a first axis and a user-actuated force application component mounted to the force transfer arrangement and wherein, in use, the force transfer arrangement rotates around the first axis and the force application component rotates around a second axis which is on the force transfer arrangement.

The direction of rotation of the force transfer arrangement around the first axis may be opposite to the direction of rotation of the force application component around the second axis.

Preferably, the arrangement is such that with rotation of the force application component about the second axis, the force application component reaches a point which is at a maximum radial distance from the first axis and wherein the direction of said maximum radial distance changes, moving around the first axis with subsequent rotation of the force application component.

The force transfer arrangement may include a first crank member which is mounted to the support structure for rotation about said first axis, a first non-rotatable drive transfer device fixed to the support structure at the first axis, a second crank member which is mounted to the first crank member for rotation about said second axis which is spaced apart from said first axis, and a second drive transfer device which is mounted for rotation about the second axis together with the second crank member, and wherein said force application component is mounted to the second crank member at a third axis which is spaced apart from the second axis and the force application component is operable to impart rotation to the second crank member about the second axis, and wherein the second drive transfer device is coupled to the first drive transfer device so that rotational movement of the second crank member about the second axis causes rotational movement of the first crank member and the second crank member in unison about the first axis.

The first crank member and the second crank member may be counter-rotatable.

The arrangement may be such that when there are S revolutions of the second crank member about the second axis there are R revolutions of the first crank member about the first axis and, in one embodiment $$\frac{R}{S} < \frac{1}{2}.$$

In another embodiment $$\frac{R}{S} > \frac{1}{2}.$$

The first drive transfer device and the second drive transfer device may be respective cogs which are coupled together by means of a drive chain, or respective pulleys which are coupled together by means of a drive belt, or an arrangement of interconnected or intermeshed gears, or any equivalent mechanism.

The exercise machine preferably includes a further force transfer arrangement which is displaced relative to said force transfer arrangement about the first axis by 180°. Thus the exercise machine may include a further first crank member which is mounted to the support structure for rotation about the first axis, a further second crank member which is mounted to the further first crank member for rotation about a further second axis which is spaced apart from the first axis, and a further force application component which is mounted to the further second crank member at a further third axis, which is spaced apart from the further second axis, and which is operable to impart rotation to the further second crank member about the further second axis, and wherein the further first crank member is displaced relative to the first crank member about the first axis by 180°.

The invention also provides an exercise machine which includes a support structure, a rotatable primary axle which is mounted to the support structure and which is centred on a first axis, a first crank member which is fixed to the primary axle and which is rotatable about the first axis, a second crank member which is fixed to the first crank member at a second axis and which is rotatable about the second axis, a force application component which is fixed to the second crank member and which is rotatable about a third axis, a first non-rotatable circular member fixed to the support structure at the first axis, a second rotatable circular member which is centred on the second axis and which is rotatable by and in unison with the second crank member, and an endless flexible element which is in a drive transfer engagement with the first and second circular members so that rotational movement of the second crank member about the second axis results in rotational movement of the first crank member and the primary axle about the first axis, and wherein the first and second circular members are cogs and the endless flexible element is an endless chain engaged with the cogs, or the first and the second circular members are pulleys and the endless flexible element is a belt which is engaged with the pulleys.

The invention further extends to a flywheel arrangement for use in an exercise machine, the flywheel arrangement including a flywheel mounted for rotation about a primary axle which is centred on a first axis, a first pulley and belt arrangement which comprises an input pulley which is fixed to the primary axle, a first pulley, a second pulley which is smaller in diameter than the input pulley and the first pulley, wherein the second pulley is fixed to the first pulley and the first and second pulleys are mounted for free rotation about a transfer axle which is mounted to support structure, and a first V-belt for transferring rotational drive from the input pulley to the second pulley, and a second pulley and belt arrangement which includes the first pulley, an output pulley which is smaller in diameter than the first pulley, and a second V-belt for transferring rotational drive from the first pulley to the output pulley, and wherein the output pulley is fixed to the flywheel so that the output pulley and the flywheel are rotatable in unison.

The flywheel arrangement is particularly suitable for use with an exercise machine of the aforementioned kind.

BRIEF DESCRIPTION OF THE DRAWINGS

The invention is further described by way of examples with reference to the accompanying drawings in which.

DESCRIPTION OF PREFERRED EMBODIMENTS

Figure 1:
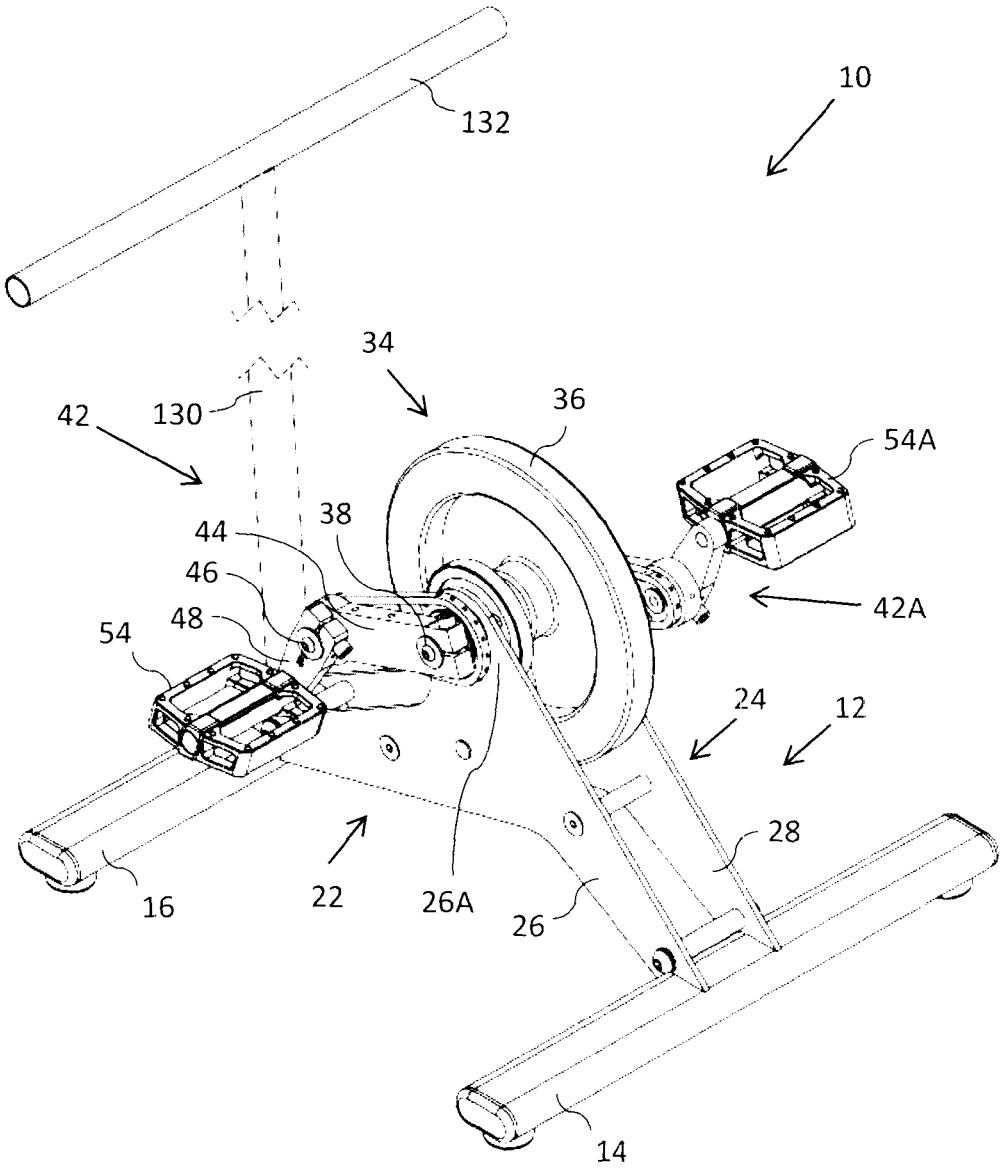
FIG. 1 is a view in perspective of an exercise machine according to one form of the invention.
Figure 2:
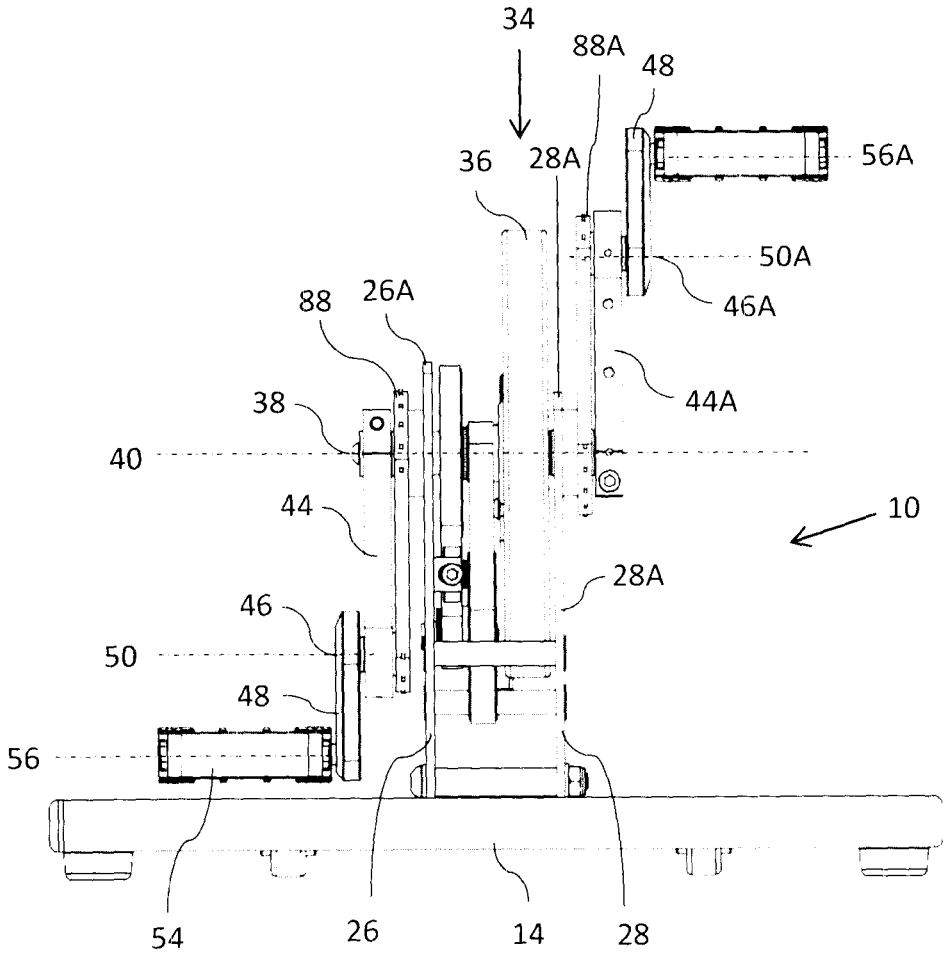
FIG. 2 is an end view of the exercise machine of FIG. 1.
Figure 3:
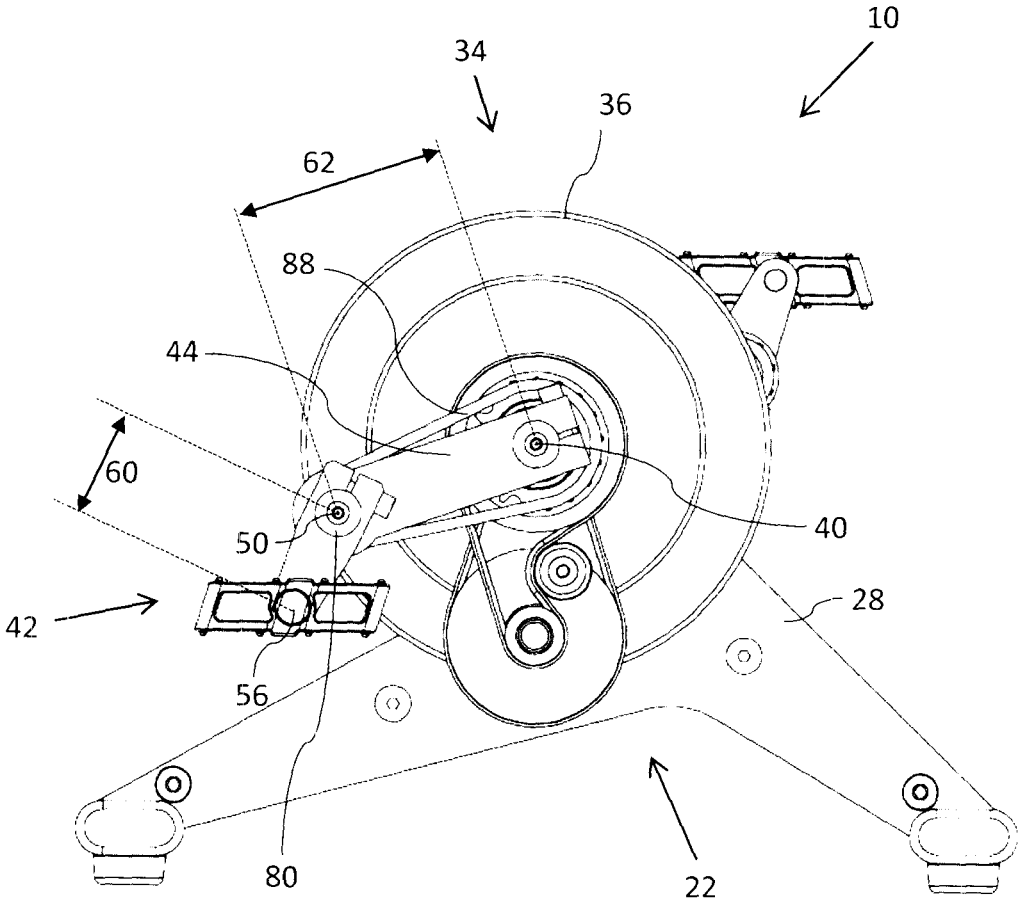
FIG. 3 is a side view of the machine of FIG. 1, but with a support plate omitted.

FIGS. 1 and 2 of the accompanying drawings are a view in perspective and an end view, respectively of an exercise machine 10 according to the invention. FIG. 3 shows the machine 10 from one side, but with a support plate omitted.

The exercise machine 10 is described hereinafter with reference to an exercise machine which is actuated by leg energy. This is exemplary, though, for the principles of the invention could be adapted to provide an exercise machine which is operable by arm energy i.e. in a hand-operated form of machine.

The exercise machine 10 includes a floor-engaging support structure 12 which has two elongate floor-engaging members 14 and 16 which are spaced apart and which are interconnected by means of two spaced apart support arrangements 22 and 24 respectively.

The support arrangement 22 includes a plate 26 with opposed ends which are respectively connected to the elongate member 14 and to the elongate member 16. A section 26A of the plate 26 extends upwardly.

The support arrangement 24 is substantially the same as the support arrangement 22 and includes a plate 28 which is similar to the plate 26 and which is connected at opposed ends to the members 14 and 16 respectively, and an upwardly extending intermediate section 28A (FIG. 2).

A flywheel arrangement 34 includes a flywheel 36 which is mounted to a primary axle 38 which in turn is rotatably supported on bearings (not shown in FIG. 1) which are respectively mounted to the opposed sections 26A and 28A. The primary axle 38 is centred on a primary axis 40 (FIG. 2).

A first force transfer arrangement 42 is located on one side of the plate 26. The first force transfer arrangement 42 includes a first crank member 44 and a second crank member 48. The first crank member 44 is connected at a first end to the primary axle 38. A second end of the first crank member 44 is rotatably connected by means of a second axle 46 to one end of the second crank member 48. The second axle 46 is aligned with a second axis 50 (FIG. 2). An opposing end of the second crank member 48 is rotatably connected to a force application component, in this embodiment in the form of a pedal 54 which is rotatable about an axle positioned on a third axis 56 (see FIG. 2), in the nature of a pedal on a conventional cycle.

The axes 40, 50 and 56 are parallel to each other—see FIG. 2.

FIG. 3 shows that the third axis 56 is displaced from the second axis 50 by a distance 60. The second axis 50 is displaced from the first or primary axis 40 by a distance 62.

Figure 4:
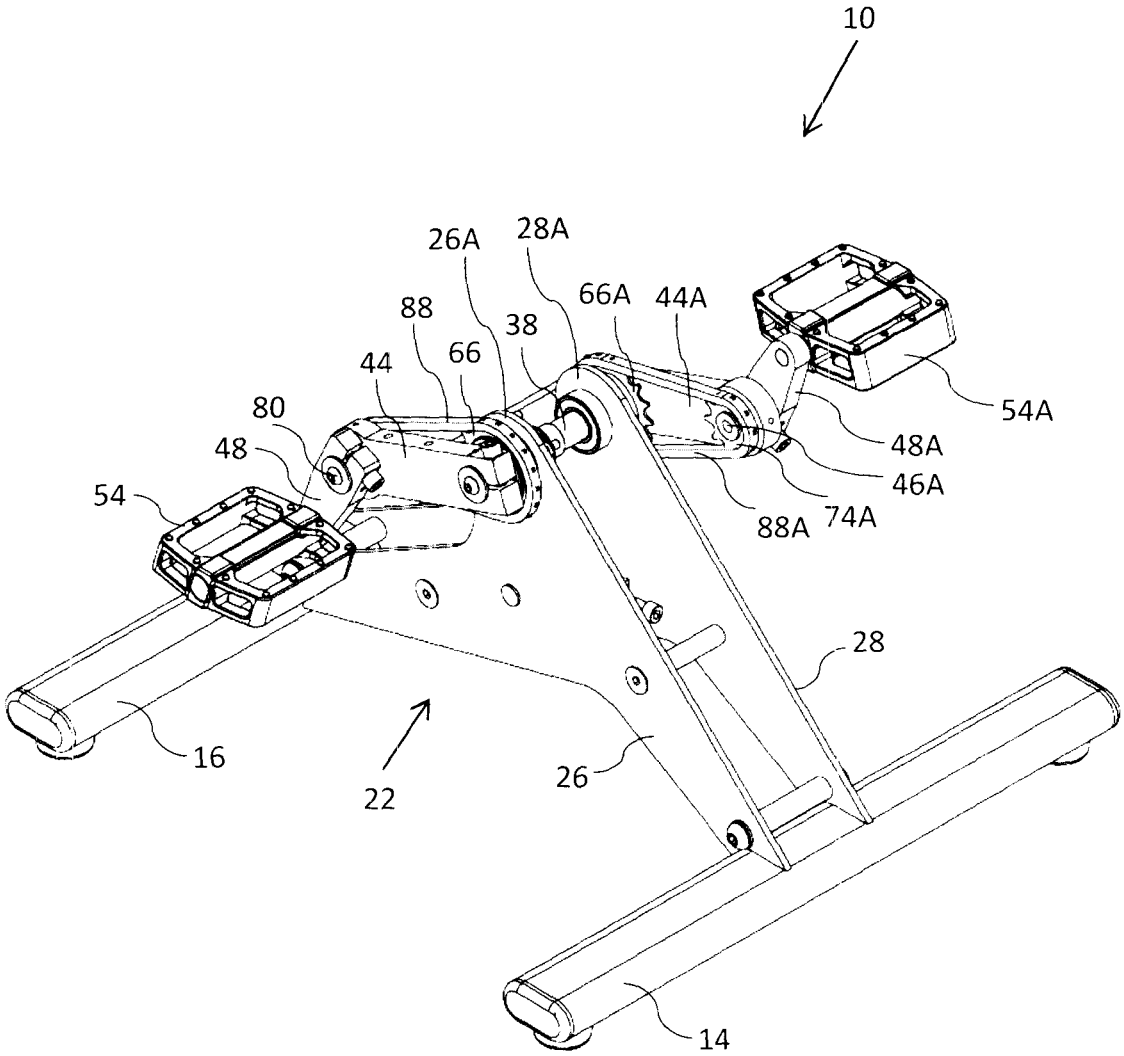
FIG. 4 shows the machine of FIG. 1 but with a flywheel structure omitted.
Figure 4A:
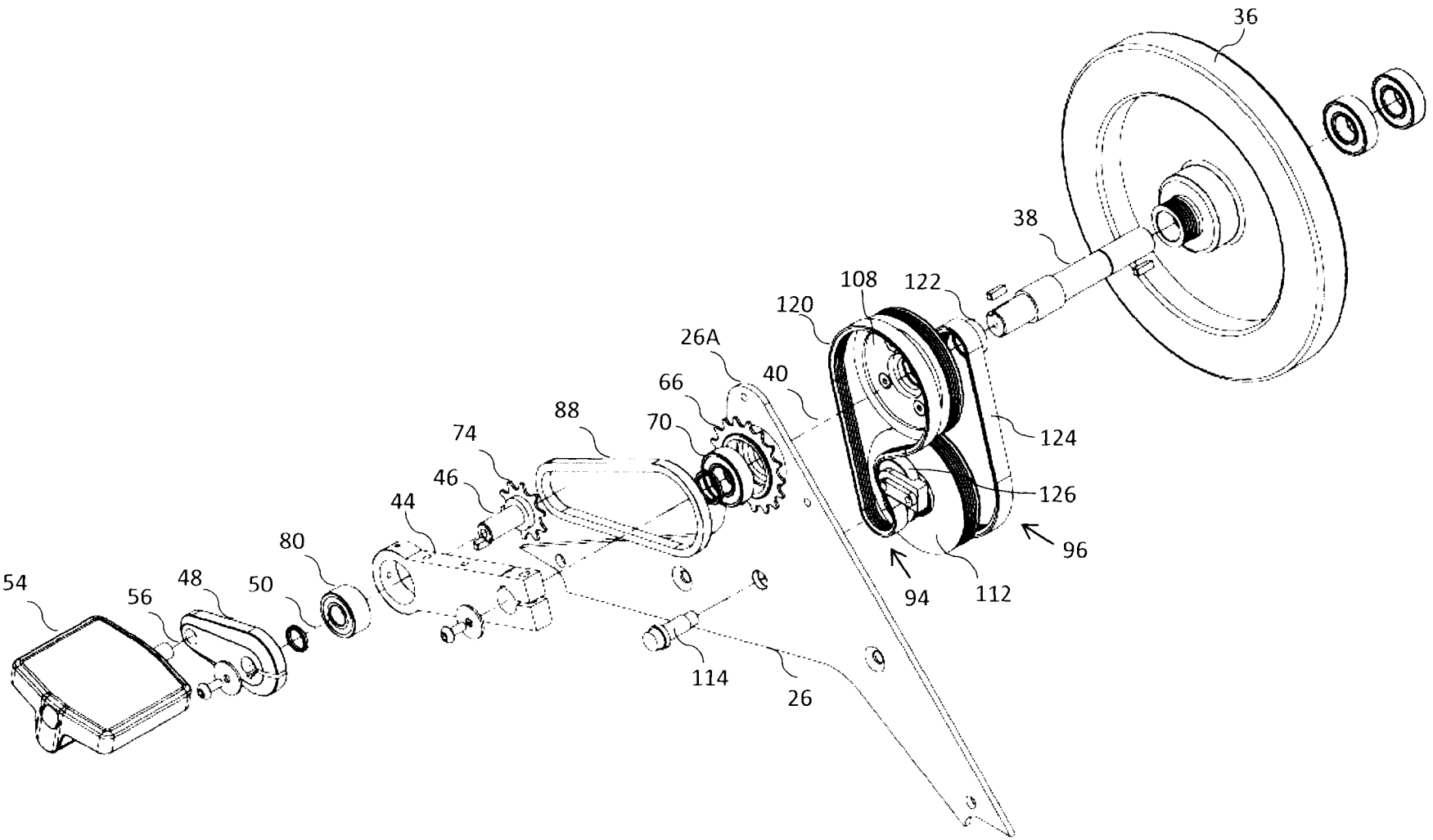
FIG. 4A is an exploded view in perspective of some of the components of the exercise machine.

FIG. 4 shows the exercise machine 10 and the primary axle 38, but with the remainder of the flywheel arrangement 34 removed. FIG. 4A is an exploded perspective view of one side of the machine 10 in FIG. 4 but with the flywheel 36 included.

FIG. 4A shows a first drive transfer device which comprises a non-rotatable cog 66, which is fixed to the plate section 26A. The primary axle 38 passes through the cog 66 and is rotatably supported on a bearing 70 which is secured to the plate section 26A.

FIG. 4A also shows a second drive transfer device which comprises a cog 74 which is fixed to and which is rotatable together with the second axle 46. The second axle 46 is rotatably supported on a bearing 80 which is centred on the second axis 50. A continuous chain 88 is looped around the cog 66 and the cog 74 to transfer rotational movement of the second crank member 48 to the first crank member 44 which, in turn, transfers rotational movement to the primary axle 38.

As is shown mainly in FIG. 4 the aforementioned configuration is repeated on an opposing side of the support structure i.e. on an outer side of the plate 28, in that a further force transfer arrangement 42A is located on that side, coupled to the primary axle 38. The further force transfer arrangement 42A includes another first crank member 44A and another second crank member 48A. A cog 66A is fixed to the plate section 28A. The further first crank member 44A is mounted to a second end of the primary axle 38 which is supported on a bearing 70A fixed to the plate section 28A. The further second crank member 48A has attached to it a further second force application component comprising a second pedal 54A. A cog 74A is fixed to another second axle 46A which is rotatably supported on a bearing 80A (not shown), which is centred on a corresponding further second axis 50A (see FIG. 2) and which is mounted to the further second crank member 48A. The further second axle 46A is rotatable about the further second axis 50A. A continuous chain 88A is looped around the cog 66A and the cog 74A to transfer rotational movement of the further second crank member 48A to the further first crank member 44A which, in turn, transfers rotational movement to the primary axle 38.

The first crank member 44 is displaced by 180° about the axis 40 relative to the opposing further first crank member 44A i.e. the arrangement is similar to that adopted in respect of a conventional pedal cycle.

Figure 5:
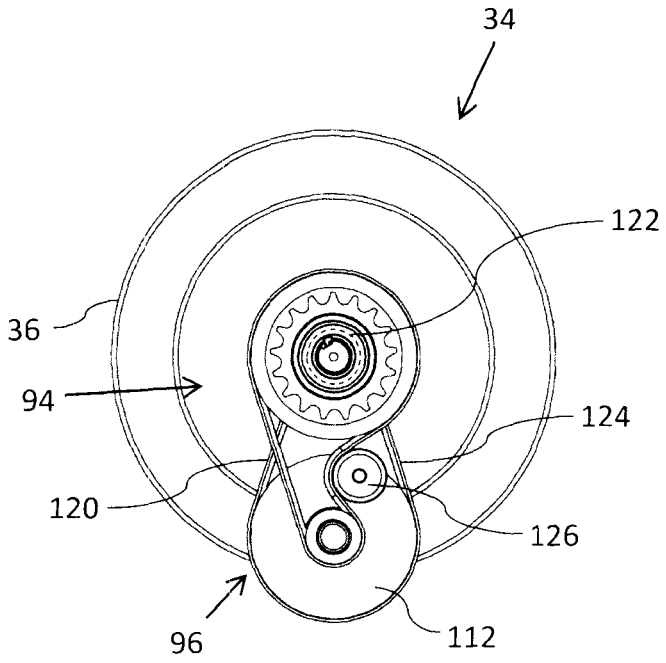
FIGS. 5 and 6 are respectively side and perspective views of a flywheel structure which is included in the machine of FIG. 1.
Figure 6:
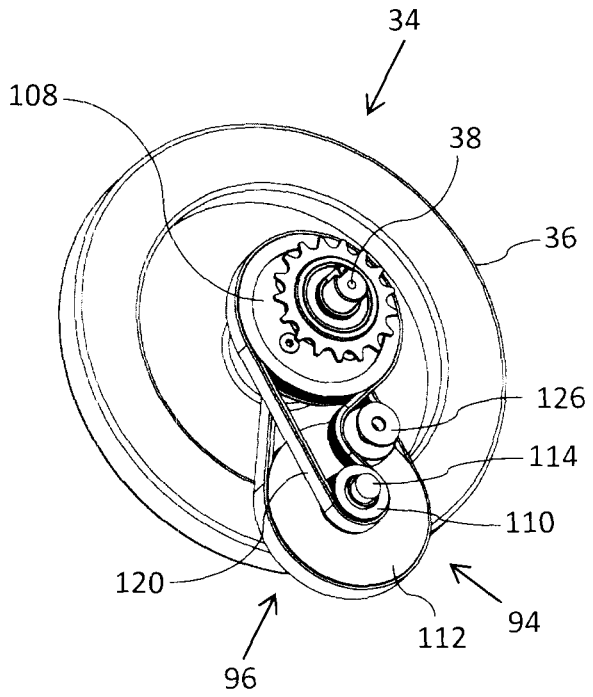

FIG. 5 shows the flywheel arrangement 34 from one side, and FIG. 6 shows the flywheel arrangement 34 in perspective.

The flywheel arrangement 34 includes a drive transfer system comprising two pulley and belt arrangements 94 and 96 respectively, on one side of the flywheel 36, which are used to increase the rotational speed of the flywheel 36 relative to the rotational speed of the primary axle 38.

The first pulley and belt arrangement 94 comprises an input pulley 108, fixed to the primary axle 38, which drives a relatively smaller second pulley 110 which is fixed to and centred on a relatively larger first pulley 112. The second pulley 110 and the first pulley 112 are mounted for free rotation about a transfer axle 114 which is supported on the plate 26 (see FIG. 4A). Drive is transferred from the input pulley 108 to the second pulley 110 by means of a first V-belt 120.

The second arrangement 96 includes the first pulley 112, a relatively smaller output pulley 122 (see FIG. 4A) and a second V-belt 124.

When the primary axle 38 is rotated at a first speed by means of force applied to the pedal 54 (as is described hereinafter), the input pulley 108 is simultaneously rotated. The second pulley 110, which is smaller in diameter than the input pulley 108, is then rotated at a second speed which is higher than the first speed.

The first pulley 112 which is directly connected to the second pulley 110 is simultaneously rotated at the higher speed. Rotational drive is transferred to the output pulley 122 by means of the second V-belt 124. The output pulley 122 rotates at a higher speed than the first pulley 112. The output pulley 122 is fixed to the flywheel 36. Thus the flywheel 36 is also rotated at a high speed about the primary axle 38.

A tensioner 126 is optionally used to adjust the tension in the first V-belt 120.

The pulley and belt arrangements (94, 96) increase the rotational speed of the flywheel 36, relative to the rotational speed of the primary axle 38, by a factor which is determined by the ratios of the diameters of the input pulley 108 and of the second pulley 110, and of the first pulley 112 and the output pulley 122, respectively. In a preferred embodiment, the rotational speed of the flywheel 36 is increased by a factor of 8, relative to the rotational speed of the axle 38.

The flywheel arrangement 34 is particularly compact. The two pulley and belt arrangements 94, 96 are located on one side on the flywheel 36, and only a narrow space is required between the plates 26 and 28 to accommodate the arrangement 34. Also, due to the increase in the rotational speed of the flywheel 36, a flywheel of a lesser mass can be used to provide the required momentum to ensure a smooth pedalling motion.

Referring again to FIG. 1 an upright member 130 is positioned centrally on the floor engaging member 16. An upper end of the upright member 130 carries a handle 132 for user support when the machine 10 is in use.

When a user, standing on the pedals 54 and 54A, exerts a pedalling action it is normally necessary for the user to brace himself by holding opposed ends of the handle 132 on the upright member 130. Referring to the pedal 54 only, as the user pedals, the second crank member 48 is rotated about the axis 50. The second axle 46 and the cog 74 are rotated in unison. The chain 88 links the cog 74 to the cog 66. As the cog 66 is fixed (non-rotatable) the chain 88 exerts a rotating action on the second axle 46 which is transferred to the first crank member 44 which is thus caused to rotate together with the primary axle 38 about the first axis 40. The rotating action is such that the second crank member 48 rotates in one direction, and the first crank member 44 is caused to rotate in an opposing direction.

Figure 7:
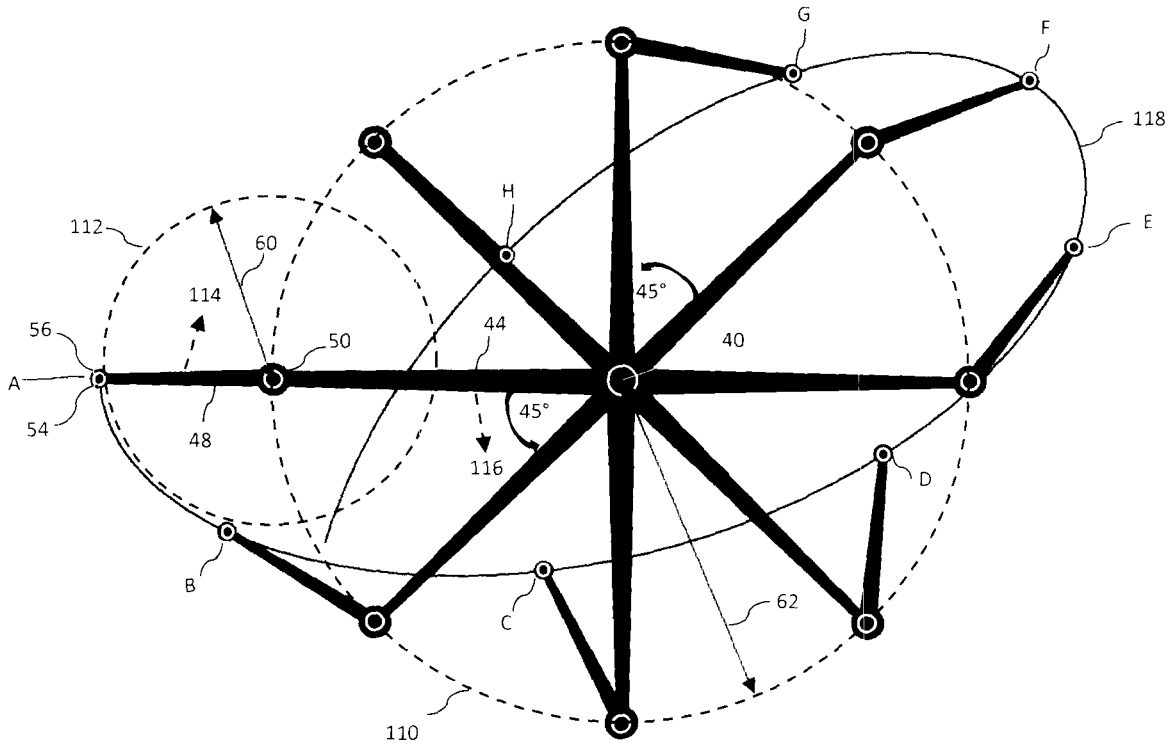
FIG. 7 illustrates schematically an initial path of travel, during use of the machine of FIG. 1, of a foot pedal of the machine.

FIG. 7 schematically illustrates the first crank member 44, the second crank member 48 and the axes 40, 50 and 56 in horizontal alignment with one another. The third axis 56 is at a point A. The first crank member 44 is constrained to rotate about the first axis 40. Thus, the second axis 50 moves on a circular path 110, indicated in dotted outline, which has a radius equal to the dimension 62, around the first axis 40. The second crank member 48 is constrained to rotate about the second axis 50 and thus the third axis 56 follows a circular path 112, with a radius equal to the dimension 60, around the second axis 50 which moves continuously along the circular path 110. The movement of the second crank member 48, about the second axis 50, is constrained by a drive transfer mechanism consisting of the cog 66, the cog 74 and the endless chain 88 (see FIG. 4A).

When the first crank member 44 rotates about the first axis 40 through R revolutions, the second crank member 48 rotates about the second axis 50 through S revolutions. The relationship between R and S is determined by the number of teeth on the cog 74 (N) to the number of teeth on the cog 66 (M). Thus $$\frac{N}{M} = \frac{R}{S}.$$

If $$N = \frac{M}{2}$$

then, for each revolution of the first crank member 44 the second crank member 48 makes two revolutions i.e.

$$\frac{R}{S} = \frac{1}{2}.$$

Under these conditions the pedal 54, which is centred on the third axis 56, follows a path which forms a closed loop which is in the shape of an ellipse which has a major axis which is, and which remains, horizontal. Thus the machine can be constructed, but in a particularly compact form, to replicate the elliptical movement path of existing machines.

In a particular example assume that the cog 74, aligned with the second axis 50, has 10 teeth (i.e. N=10) and that the cog 66, aligned with the first axis 40, has 17 teeth (i.e. M=17). Thus $$\frac{N}{M} = \frac{R}{S} = \frac{10}{17} > \frac{1}{2}.$$

Also assume that the second crank member 48 is rotated in a clockwise direction 114 about the second axis 50 on the circular path 112. The first crank member 44 is then rotated in an anti-clockwise direction 116 about the first axis 40 on the circular path 110. The foot pedal 54, on the axis 56 then travels along an extended movement path 118 which is a combination of the movement of the first crank member 44 with the movement of the second crank member 48. Consequently the range of motion during exercise is extended, thereby improving flexibility and mobility of the exerciser.

The path 118 follows an open-ended loop pattern, which is referred to herein as being "open-ended elliptical". FIG. 7 shows the first crank member 44 at successive locations which are angularly spaced apart by 45°. This is exemplary only. This movement of the first crank member 44 is associated with corresponding movement of the third axis 56, traversing the path 118, from the point A to successive locations B, C, D, E, F, G and H. In the example mentioned (N=10; M=17) ten rotations of the first crank member 44 and 17 rotations of the second crank member 48 are required before the third axis 56 returns to the starting point A shown in FIG. 7 i.e. with the components 44 and 48 again in horizontal alignment with each other.

The directions of rotation referred to (clockwise for the second crank member 48 and anti-clockwise for the first crank member 44) are exemplary only for an exerciser can operate the machine 10 with the rotational directions reversed i.e. clockwise for the first crank member 44 and anti-clockwise for the second crank member 48.

Figure 8:
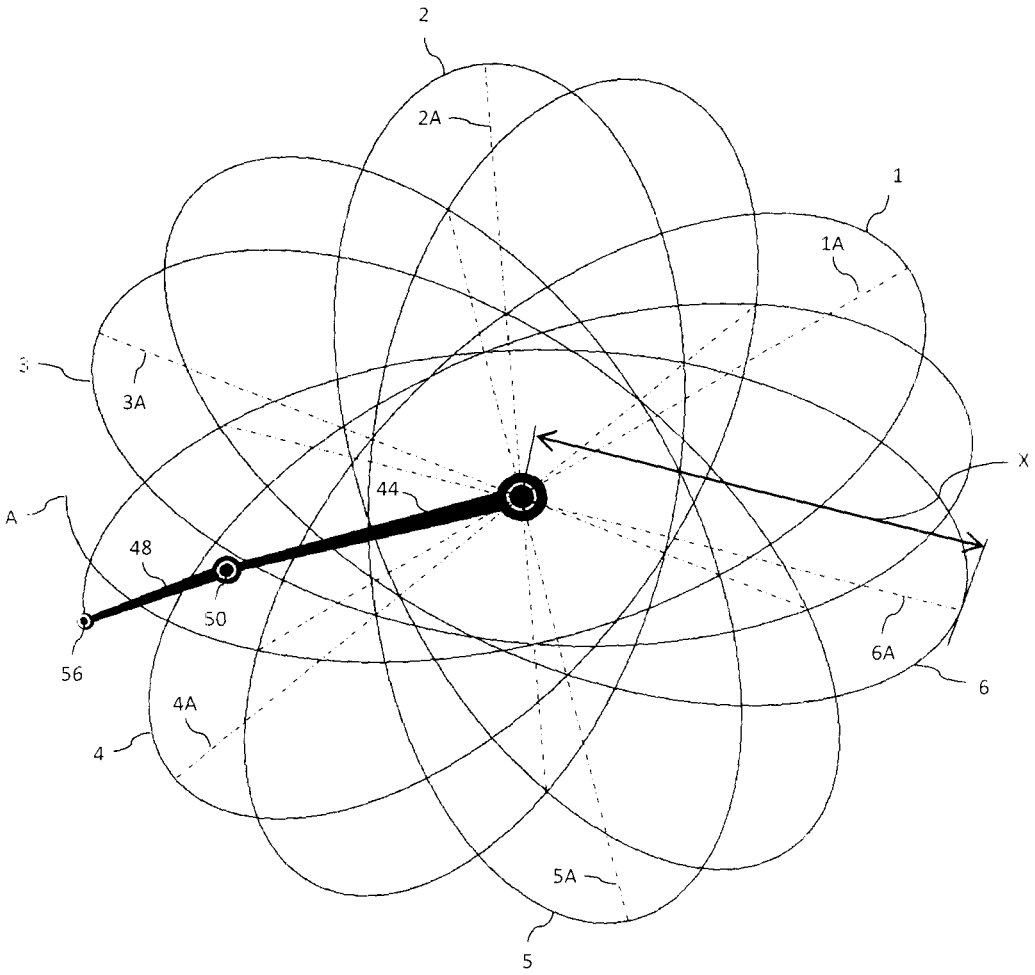
FIG. 8 illustrates further progressions of the path of exercise travel shown in FIG. 7.

FIG. 8 illustrates the path of movement after six revolutions of the first crank member 44. Each revolution results in an open-ended elliptical loop or path of movement (1 to 6) and each loop is "centred" on a respective major axis 1A to 6A, which axes are shown as dotted lines.

Figure 9:
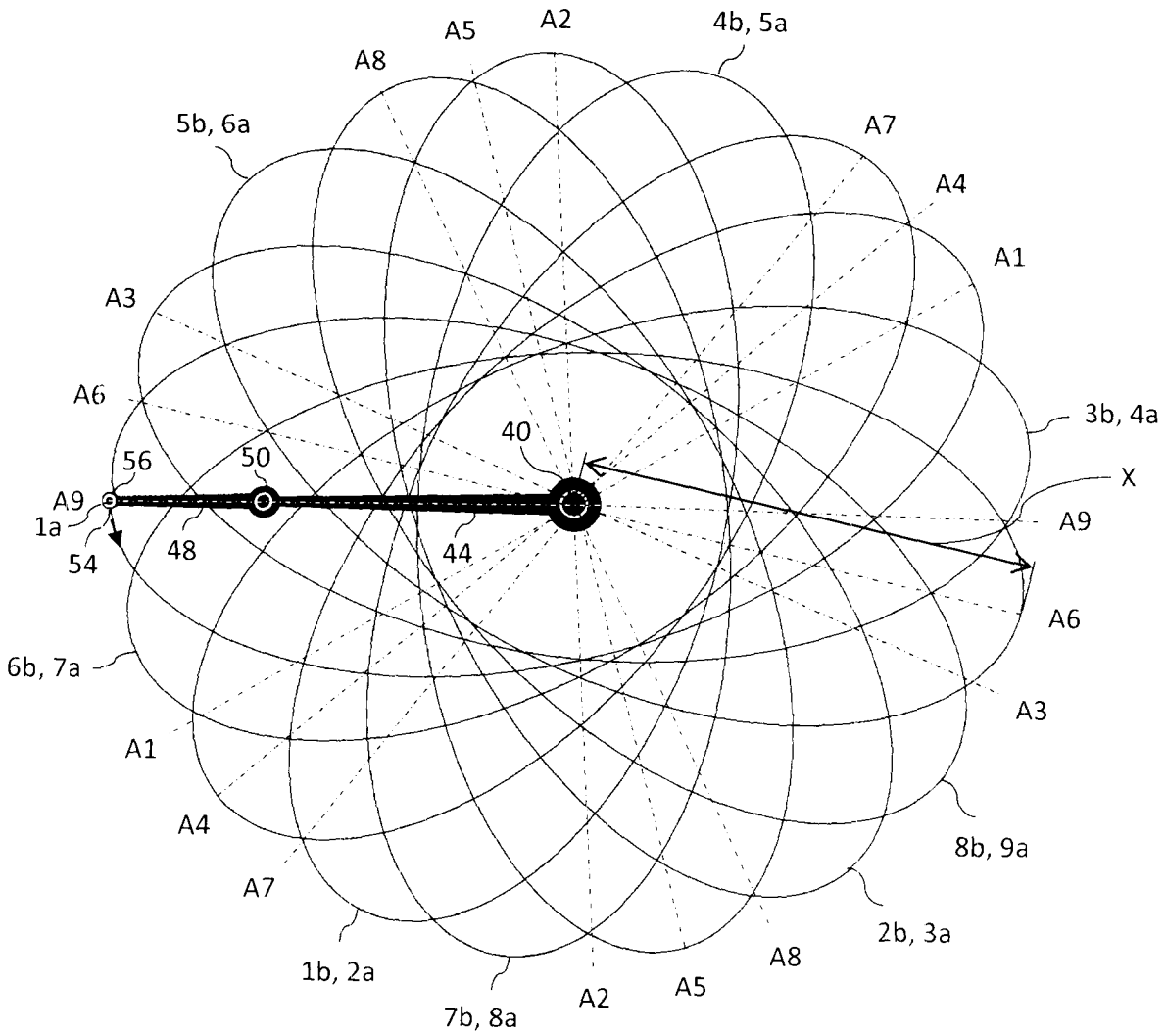
FIG. 9 illustrates an extended path of travel up to a point at which the path of travel starts repeating itself.

FIG. 9 illustrates an extended path which is travelled by the third axis 56 and the pedal 54 during ten revolutions (each of 360°) of the first crank member 44 (in an anticlockwise direction) and seventeen revolutions (in a clockwise direction) of the second crank member 48. The pedal 54, located at the axis 56, initially at the point 1*a*, is finally returned to the point 1*a*. FIG. 9 shows that eight and a half open-ended elliptical paths 1 to 8, and half of a path 9 have been traversed. The first path (1) which extends between points 1*a* and 1*b*, has a major axis A1. Each following path, starting with an "a" and ending with a "b" with its respective axis indicated with an "A" has a different orientation of its major axis. With the first crank 44 rotating in an anticlockwise direction and the second crank 48 rotating in a clockwise direction, successive axes of the paths move in an anticlockwise direction about the first axis 40.

In practical terms this means that during an exercise cycle of ten revolutions of the first crank 44 about the first axis 40 and seventeen rotations of the second crank member 48 about the second axis 50, the exercise movement path has 8½ open-ended elliptical loops which are at different inclinations. The changing of the inclinations takes place automatically and there is no need for an exerciser to reconfigure the machine while exercising. This capability is achieved automatically in response to the value $$\frac{N}{M}.$$

In another configuration, assume that N=15 and M=34. Thus $$\frac{N}{M} = \frac{R}{S} = \frac{15}{34} < \frac{1}{2}.$$

In this case fifteen revolutions of the first crank member 44 are then required before the exercise pattern commences repeating itself.

The shape of a loop generated during operation of the machine is dependent on $$\frac{N}{M}$$

i.e. on $$\frac{R}{S}.$$

In general, if $$\frac{R}{S} < \frac{1}{2}$$

then the shape of the loop is "flatter" relative to the shape of the loop in the case where $$\frac{R}{S} > \frac{1}{2}.$$

If $$\frac{R}{S} = \frac{1}{2}$$

then for each revolution of the first crank member 44, the second crank member 48 makes two revolutions. As previously indicated this means that the foot pedal 54 follows an elliptical path with a relatively long major axis which does not change for succeeding revolutions of the primary axle 38.

The preceding description relates to the movement on one side of the support structure 12 i.e. adjacent to and on an outer side of the plate 26. The movement on the other side of the support structure 12 i.e. adjacent to and on an outer side of the plate 28, mirrors the movement on the first side of the support structure although it is 180° out of phase thereto.

The movement of the foot pedal 54 can be expressed in different terms. FIGS. 7, 8 and 9 show that the axis 56 on which the foot pedal 54 is mounted is displaced from the first axis 40 by a maximum radial distance X which is equal to the sum of the dimensions 60 and 62 i.e. X=60+62. In each subsequent loop of travel the axis 56 again reaches a point of maximum radial displacement X, from the first axis 40 but the direction in which such radial displacement extends changes, for that direction rotates about the first axis 40 as the machine 10 is used. This means that the inclination of the corresponding loop or path of travel also changes in a rotational sense around the first axis 40.

Reference has been made to the use of cogs and chains forming parts of the drive transfer devices. The cogs 66 and 74, and 66A and 74A, could be replaced by pulleys, and the chains 88 and 88A could be replaced by belts, preferably V-belts or toothed belts which are coupled to the pulleys. However, to avoid slippage, the cog and chain assemblies are more suitable than such pulley and belt assemblies.

If pulleys are used to replace the cogs 74 and 66, and 74A and 66A, then the ratio of the radii of the pulleys plays the same role as the ratio of the number of teeth $$\left(\frac{N}{M}\right).$$

In each instance the respective ratio determines the value $$\frac{R}{S}.$$

Figure 10:
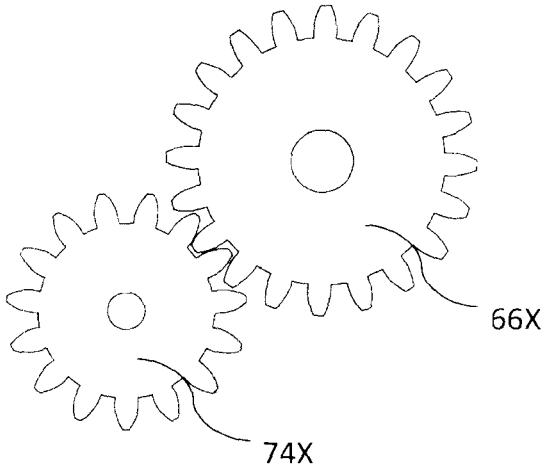
FIGS. 10 and 11 illustrate alternative drive systems for the machine which do not rely on the use of an endless chain.
Figure 11:
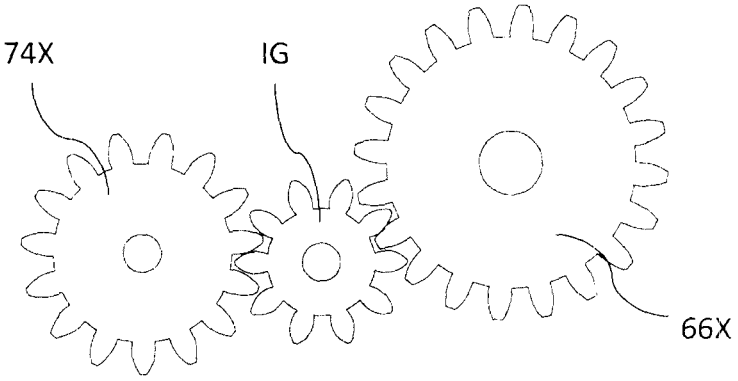

In another, but less preferred, embodiment, as is shown in FIGS. 10 and 11, the cogs 66 and 74 are replaced by gears 66X and 74X respectively and the chains 88, 88A are dispensed with. FIG. 10 shows the gears 66X and 74X which are directly meshed with each other, while FIG. 11 shows the gears 66X and 74X which are indirectly meshed together via an intermediate gear IG. A similar modification would then be made to the other side of the machine.

The exercise machine, 10 in any form $$\left(\text{i.e. } \frac{R}{S} = \frac{1}{2} \text{ or } \frac{R}{S} \neq \frac{1}{2}\right),$$

has a compact configuration with a small footprint. If $$\frac{R}{S}$$

≠½ the machine provides a foot movement exercise path which follows a loop with an open-ended elliptical form with a major axis of each loop varying in inclination relative to the horizontal. As pointed out this means that the foot pedal axis 56 reaches a maximum radial distance from the first axis 40 and the inclination of the radial distance changes in a rotational sense around the first axis 40. The number of different loops which occurs before the axis 56 returns to a starting point is dependent on the ratio $$\frac{R}{S}.$$

The net effect is that the feet of a user exercising on the machine do not move repetitively on the same path. This variety in the movement path is important for both mental and physiological reasons in terms of overcoming exercise boredom and to continue challenging the muscles without reaching a training plateau.

The use of the flywheel arrangement provides a smooth transition for a user as the axis changes from one loop to another.

The invention has been described with reference to the use of pulleys and V-belts in the flywheel arrangement 34. A similar effect can be achieved through the use of sprockets and chains, or gears, but it has been found that meshing gears result in noise during operation and backlash, and make this option undesirable. As such, the preferred embodiment makes use of belts such as V-belts or toothed belts which engage with correspondingly adapted pulleys.

Figure 12:
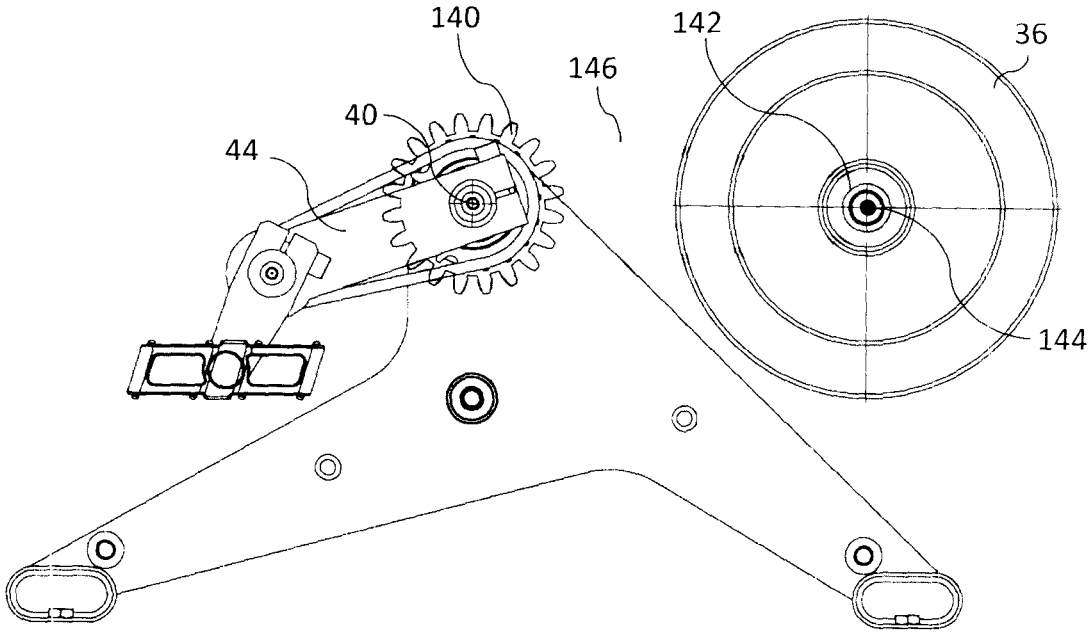
FIG. 12 illustrates a machine which is similar to that shown in FIG. 1 but which has a less compact form of construction.

The compact configuration shown in FIG. 1 is a preferred form of construction. FIG. 12 shows an alternative embodiment 10A in which the flywheel 36 is displaced from the first axis 40. With this structure a relatively large gear 140 is fixed to and is rotatable together with the primary axle 38. A relatively small cog 142 is coupled to an axle 144 which is fixed to the flywheel 36. An endless chain 146 directly drives the cog 142 from the gear 140 thereby to increase the rotational speed of the flywheel 36 relative to the rotational speed of the first crank member 44. If required the cog and chain arrangement could be replaced by pulleys and belts.

Figure 13:
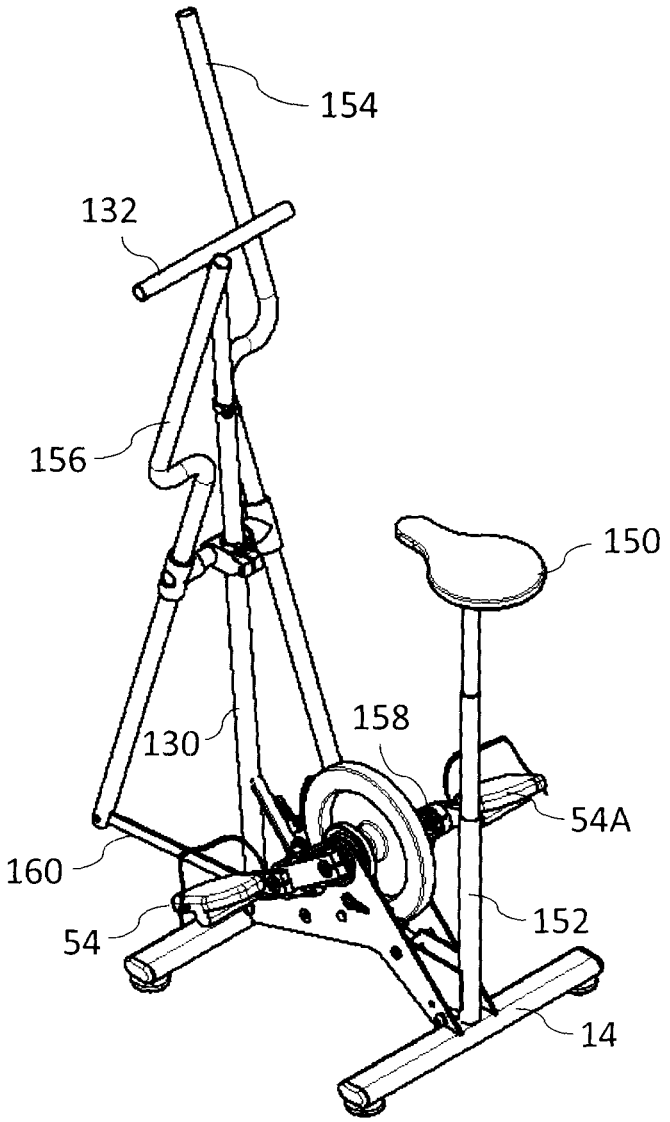
FIG. 13 illustrates a machine which is similar to that shown in FIG. 1 but with a seat and handles connected to the machine.

FIG. 13 shows a seat 150 fitted to a support 152 which extends upwardly from a junction of the member 14 and the plates 26 and 28. This arrangement enables a person to exercise from a seated position. Handles 154 and 156 are pivotally mounted to the upright member 130. Lower ends of the handles 154, 156 are pivotally coupled via respective linkages 158, 160 to the pedals 54 and 54A. An exerciser can then grip the handles 154 and 156, which move to and fro in harmony with the pedals 54 and 54A, and so exercise the arms and upper body.

The invention claimed is:

1. An exercise machine (10) comprising:

a support structure (12);

a first crank member (44) which is mounted to the support structure (12) for rotation about a first axis (40);

a first non-rotatable drive transfer device (66) fixed to the support structure (12) at the first axis (40);

a second crank member (48) which is mounted to the first crank member (44) for rotation about a second axis (50) which is on the first crank member (44) and which is spaced apart from the first axis (40);

a second drive transfer device (74), which is mounted for rotation about the second axis (50) together with the second crank member (48); and a user-actuated force application component (54) which is mounted to the second crank member (48) at a third axis (56) which is spaced apart from the second axis (50) and which is operable to impart rotation to the second crank member (48) about the second axis (50); wherein the second drive transfer device (74) is coupled to the first non-rotatable drive transfer device (66) so that rotational movement of S revolutions of the second crank member (48) about the second axis (50) causes rotational movement of R revolutions of the first crank member (44) and the second crank member (48), in unison, about the first axis (40), and wherein $R/S \neq 1/2$, whereby a movement path of the third axis (56) about the first axis (40) for one revolution of the third axis (56) about the first axis (40) is different from the movement path of the third axis (56) about the first axis (40) for a subsequent revolution of the third axis (56) about the first axis (40).

2. The exercise machine (10) of claim 1 further comprising a flywheel (36) which is mounted to be rotatable in response to rotation of the first crank member (44) about the first axis (40).

3. The exercise machine (10) of claim 2 wherein the flywheel (36) is rotatable about the first axis (40).

4. The exercise machine (10) of claim 1 wherein:

the first non-rotatable drive transfer device (66) and the second drive transfer device (74) are cogs; and the exercise machine (10) further comprises a drive transfer arrangement (88), the drive transfer arrangement (88) comprising an endless chain engaged with the cogs.

5. The exercise machine (10) of claim 1 wherein:

the first non-rotatable drive transfer device (66) and the second drive transfer device (74) are pulleys; and the exercise machine (10) further comprises a drive transfer arrangement (88), the drive transfer arrangement (88) comprising an endless belt which is engaged with the pulleys.

6. The exercise machine (10) of claim 1 wherein with rotation of the second crank member (48) about the second axis (50), the third axis (56) reaches a point which is at a maximum radial distance from the first axis (40) and wherein a direction of said maximum radial distance changes, moving around the first axis (40) with subsequent rotation of the second crank member (48).

7. The exercise machine (10) of claim 1 wherein the first crank member (44) and the second crank member (48) counter-rotate relative to one another.

8. The exercise machine (10) of claim 1, further comprising:

a flywheel (36) which is mounted to be rotatable in response to rotation of the first crank member (44) about the first axis (40) and which includes a drive transfer system for increasing a rotational speed of the flywheel (36) relative to a rotational speed of the first crank member (44).

9. The exercise machine (10) of claim 8 wherein the flywheel (36) is rotatable about the first axis (40).

10. An exercise machine (10) comprising:

a support structure (12);

a crank member (48);

a pedal (54) mounted to the crank member (48), the pedal (54) rotating on the crank member (48) about a pedal axis (56); and in response to a user pedaling the exercise machine (10) using the pedal, means for moving the pedal axis (56) in an open-ended elliptical path of movement, such that a first rotational path of the pedal axis (56) is different from a second and subsequent rotational path of the pedal axis (56).

11. The exercise machine (10) of claim 10 wherein:

said crank member (48) defines a second crank member (48); and said means for moving the pedal axis (56) comprises:

a first crank member (44) which is mounted to the support structure (12) for rotation about a first axis (40), the second crank member (48) being mounted for rotation about a second axis (50) which is on the first crank member (44) and which is spaced apart from the first axis (40);

a first non-rotatable drive transfer device (66) fixed to the support structure (12) at the first axis (40); and a second drive transfer device (74) mounted for rotation about the second axis (50) together with the second crank member (48);

wherein:

the pedal axis (56) is spaced apart from the second axis (50) and is operable to impart rotation to the second crank member (48) about the second axis (50);

the second drive transfer device (74) is coupled to the first non-rotatable drive transfer device (66) such that rotational movement of S revolutions of the second crank member (48) about the second axis (50) causes rotational movement of R revolutions of the first crank member (44) and the second crank member (48), in unison, about the first axis (40), and wherein $R/S \neq 1/2$.

12. The exercise machine (10) of claim 11 further comprising a flywheel (36) which is mounted to be rotatable in response to rotation of the first crank member (44) about the first axis (40).

13. The exercise machine (10) of claim 12 wherein the flywheel (36) is rotatable about the first axis (40).

14. The exercise machine (10) of claim 11 wherein: the first non-rotatable drive transfer device (66) and the second drive transfer device (66) are cogs; and the exercise machine (10) further comprises a drive transfer arrangement (88), the drive transfer arrangement (88) comprising an endless chain engaged with the cogs.

15. The exercise machine (10) of claim 11 wherein: the first non-rotatable drive transfer device (66) and the second drive transfer device (74) are pulleys; and the exercise machine (10) further comprises a drive transfer arrangement (88), the drive transfer arrangement (88) comprising an endless belt which is engaged with the pulleys.

16. An exercise machine (10) of claim 11 wherein with rotation of the second crank member (48) about the second axis (50), the third axis (56) reaches a point which is at a maximum radial distance from the first axis (40) and wherein a direction of said maximum radial distance changes, moving around the first axis (40) with subsequent rotation of the second crank member (48).

17. The exercise machine (10) of claim 11 wherein the first crank member (44) and the second crank member (48) counter-rotate relative to one another.

18. The exercise machine (10) of claim 11, further comprising: a flywheel (36) which is mounted to be rotatable in response to rotation of the first crank member (44) about the first axis (40) and which includes a drive transfer system for increasing a rotational speed of the flywheel (36) relative to a rotational speed of the first crank member (44).

19. The exercise machine (10) of claim 18 wherein the flywheel (36) is rotatable about the first axis (40).

* * * * *